US009347235B2

(12) United States Patent
You et al.

(10) Patent No.: US 9,347,235 B2
(45) Date of Patent: May 24, 2016

(54) VIBRATION ISOLATION STRUCTURE USING PRECAST CONCRETE SHEAR-KEY BLOCK AND ANTI-VIBRATION PAD, AND METHOD FOR CONTROLLING ANTI-VIBRATION OF STRUCTURE USING THE SAME

(71) Applicant: KOREA INSTITUTE OF CIVIL ENGINEERING AND BUILDING TECHNOLOGY, Gyeonggi-Do (KR)

(72) Inventors: Young-Chan You, Gyeonggi-Do (KR); Ki-Sun Choi, Gyeonggi-Do (KR); Sang-Ki Park, Gyeonggi-Do (KR)

(73) Assignee: KOREA INSTITUTE OF CIVIL ENGINEERING AND BUILDING TECHNOLOGY, Gyeonggi-Do (KR)

( * ) Notice: Subject to any disclaimer, the term of this patent is extended or adjusted under 35 U.S.C. 154(b) by 0 days.

(21) Appl. No.: 14/536,691

(22) Filed: Nov. 10, 2014

(65) Prior Publication Data

US 2015/0128511 A1 May 14, 2015

(30) Foreign Application Priority Data

Nov. 14, 2013 (KR) ..... 10-2013-0138461
Aug. 21, 2014 (KR) ..... 10-2014-0109161

(51) Int. Cl.
*E04H 9/02* (2006.01)
*E04B 1/98* (2006.01)

(52) U.S. Cl.
CPC .. *E04H 9/02* (2013.01); *E04B 1/98* (2013.01); *E04H 9/021* (2013.01); *E04H 9/022* (2013.01)

(58) Field of Classification Search
CPC ..... E04B 1/98; E04H 9/00; E04H 9/02; E04H 9/021
See application file for complete search history.

(56) References Cited

U.S. PATENT DOCUMENTS

| | | | | |
|---|---|---|---|---|
| 3,296,759 | A * | 1/1967 | Pavlecka | 52/234 |
| 3,921,240 | A * | 11/1975 | Fyfe | 14/73.5 |
| 4,187,573 | A * | 2/1980 | Fyfe et al. | 14/73.5 |
| 4,338,758 | A * | 7/1982 | Hagbjer | 52/745.2 |
| 4,727,695 | A * | 3/1988 | Kemeny | 52/167.8 |
| 4,887,788 | A * | 12/1989 | Fischer | E01D 19/041 248/562 |
| 5,054,251 | A * | 10/1991 | Kemeny | 52/167.8 |
| 5,131,195 | A * | 7/1992 | Bellavista | 52/167.1 |
| 5,568,705 | A * | 10/1996 | Bellavista | 52/167.1 |
| 7,316,389 | B2 | 1/2008 | Rawson | |
| 8,807,307 | B2 * | 8/2014 | Choi | E04H 9/02 188/105 |
| 2007/0044395 | A1 * | 3/2007 | Lu et al. | 52/167.4 |
| 2007/0157532 | A1 * | 7/2007 | Tsai | E04H 9/023 52/167.1 |
| 2013/0000226 | A1 * | 1/2013 | Sugita | E04H 9/021 52/167.7 |
| 2015/0128511 | A1 * | 5/2015 | You et al. | 52/167.7 |

FOREIGN PATENT DOCUMENTS

| | | |
|---|---|---|
| KR | 10-1323587 | 11/2013 |
| KR | 10-1323588 | 11/2013 |
| KR | 10-1323589 | 11/2013 |

* cited by examiner

*Primary Examiner* — Andrew J Triggs
(74) *Attorney, Agent, or Firm* — Jianq Chyun IP Office

(57) ABSTRACT

In a structure which forms an upper structure and a lower structure divided by an anti-vibration pad for vibration isolation therein, since the concavo-convex type shear key is formed using the precast concrete shear-key block, the construction can be precisely performed according to the predetermined standard. Therefore, a vibration isolation structure using a precast concrete shear-key block and an anti-vibration pad which are capable of effectively blocking vibration and noise, and a constructing method thereof are provided.

7 Claims, 11 Drawing Sheets

VIBRATION ISOLATION STRUCTURE USING PRECAST CONCRETE SHEAR-KEY BLOCK AND ANTI-VIBRATION PAD, AND METHOD FOR CONTROLLING ANTI-VIBRATION OF STRUCTURE USING THE SAME

CROSS-REFERENCE TO RELATED APPLICATIONS

This application claims the priority benefit of Korean patent application serial no. 10-2013-0138461, filed on Nov. 14, 2013, and Korean patent application serial no. 10-2014-0109161, filed on Aug. 21, 2014. The entirety of each of the above-mentioned patent applications is hereby incorporated by reference herein and made a part of this specification.

TECHNICAL FIELD

The present invention relates to a method for controlling anti-vibration of a structure, and more particularly, to a vibration isolation structure using a precast concrete shear-key block and an anti-vibration pad which are capable of effectively blocking vibration and noise transmitted from a lower structure to an upper structure in the structure divided into the lower structure and the upper structure by the anti-vibration pad for vibration isolation, and a constructing method thereof.

BACKGROUND ART

Generally, structures constructed around an area through which a subway or another railroad passes needs a technology for blocking vibration and noise generated from vibration of vehicles, such as vibration of subway vehicles and vibration of other railroad vehicles, from being transmitted to the structures. For example, a technology using an anti-vibration pad may be used.

That is, a method in which the anti-vibration pad (a rubber pad or a spring) is installed at a lower surface of a foundation structure to reduce vibration may be used. However, in particular, when a residential structure is constructed directly on an upper portion of a section such as a railroad site, in which vibration is always generated, a high level of vibration reduction technology is required. Current techniques are not sufficiently reliable for controlling such high levels of vibration or noise.

Further, in a residential and commercial complex building, since a problem due to vibration or noise is more serious in a residential space, it is preferable to additionally construct an anti-vibration structure with respect to the residential space, rather than to block the vibration or the noise with respect to the entire building.

Also, in a residential and commercial complex building, since a pile foundation is generally used due to the fact that residential spaces are mainly located on higher floors, it is impossible to continuously install the anti-vibration pad at a lower surface of a foundation structure, and thus blocking of the vibration is unreliable.

In Korean Patent No. 10-1323587, 10-1323588, and 10-1323589 filed and registered by the applicant of the present invention, among techniques related to solving this problem, there is disclosed a "vibration isolation system in a transfer floor of apartment housing." Particularly, as illustrated in FIG. 1, according to the "vibration isolation system in the transfer floor of apartment housing" disclosed in Korean Patent No. 10-1323587, an integral type transfer floor structure for blocking vibration, which includes a concavo-convex type shear key 160, anti-vibration pads 140*a* and 140*b* and a tension restriction member 150, is provided to absorb and control vibration at a transfer floor section installed between an upper shear wall structure and a lower Rahmen structure of a residential and commercial complex building, thereby effectively controlling and blocking the vibration or the noise.

However, in the vibration isolation system in the transfer floor of apartment housing, there is a problem in that it is very difficult to precisely construct the concavo-convex type shear key 160 and the anti-vibration pads 140*a* and 140*b* at an upper structure 130*a* and a lower structure 130*b* divided by the internal anti-vibration pads according to a constant standard. That is, at a construction site, the plurality of shear keys are formed into a concavo-convex form on an upper surface of the lower structure 130*b* using concrete, and then the anti-vibration pads 140*a*, 140*b* are respectively installed at upper and lower portions 161 and 162 of the concavo-convex type shear key 160. However, it is very difficult to precisely perform the construction according to the constant standard.

DISCLOSURE

Technical Problem

The present invention is directed to providing a vibration isolation structure using a precast concrete shear-key block and an anti-vibration pad, in which a concavo-convex type shear key can be precisely constructed according to a predetermined standard and anti-vibration performance of the anti-vibration pad installed at the concavo-convex type shear key in the vibration isolation structure divided into an upper structure and a lower structure by the internal anti-vibration pad can be effectively ensured, and a constructing method thereof.

Technical Solution

To solve the problems, the present invention provides an anti-vibration pad integrated with a reaction filler located in the boundary side of the pad, which is an anti-vibration pad installed at a concavo-convex type key of the anti-vibration structure.

Typically, for example, expanded polystyrene (EPS) and expanded polypropylene (EPP) are used as foam resin materials to absorb vibration or shock.

However, when a high compressive force is applied to the rubber-based anti-vibration pad, anti-vibration performance thereof is deteriorated due to the compaction phenomena of the material and durability thereof is also lowered.

In addition, when the high compressive force is generated at the rubber-based anti-vibration pad having incompressible characteristics, a horizontal strain rate, described in FIG. 2*a*, is considerably increased. If the horizontal strain rate exceeds a predetermined value, a crack is generated at a side surface of the rubber-based anti-vibration pad, and an effective cross section is reduced.

Therefore, a phenomenon of increase in the compressive deformation in the vertical direction→increase in deformation in the horizontal direction→occurrence of a crack→reduction in the effective cross section→additionally increase in the compressive deformation in the vertical direction due to the high compressive force applied to the rubber-based anti-vibration pad restricts the application of the rubber-based anti-vibration pad.

That is, as illustrated in FIG. 1, when the rubber-based anti-vibration pad is installed at an upper portion or a lower portion of the concavo-convex type shear key of the vibration isolation structure, the compressive deformation is generated due to the incompressible property of the rubber-based anti-vibration pad, and the horizontal deformation is also generated. However, the side surface of the rubber-based anti-vibration pad is restricted by the concavo-convex type shear key, and the horizontal deformation thereof is also restricted, and thus the rubber-based anti-vibration pad does not function as an anti-vibration member. When a clearance (an outer circumference) is formed between the rubber-based anti-vibration pad and the concavo-convex type shear key to allow the horizontal deformation, the horizontal deformation of the rubber-based anti-vibration pad is allowed. However, when the deformation due to the high compressive force is increased, the crack is generated at the side surface thereof, and a vicious circle phenomenon of performance degradation, i.e., the phenomenon of the increase in the compressive deformation in the vertical direction→increase in deformation in the horizontal direction→occurrence of a crack→reduction in the effective cross section→additionally increase in the compressive deformation in the vertical direction, is generated.

Therefore, in the present invention, the clearance is formed between the rubber-based anti-vibration pad and the concavo-convex type shear key to allow the horizontal deformation of the rubber-based anti-vibration pad, and the reaction filler having a predetermined stiffness is installed at the clearance.

The reaction filler having the predetermined stiffness is formed of a silicone material or the like to restrict the horizontal strain rate within a predetermined range, as well as to provide a reaction force against the horizontal strain rate, such that the horizontal deformation is returned to its original position. Further, the reaction filler can provide not only the predetermined stiffness but also the damping as an additional function, and can also considerably reduce the stain rate due to vibration, and thus a large effect on vibration control may be expected.

Furthermore, the concavo-convex type shear key formed in the anti-vibration structure is formed using the precast concrete shear-key block.

That is, the lower structure forming the anti-vibration structure is integrally formed with the precast concrete shear-key block, such that the precast concrete shear-key block is exposed on the lower structure.

At this time, the precast concrete shear-key block is manufactured to include the concrete body and the concrete concavo-convex type shear key, and the concrete concavo-convex type shear key is foamed in a concavo-convex shape to protrude from the concrete body.

Therefore, the anti-vibration pad integrated with the above-described reaction filler is installed between the concrete concavo-convex type shear key and an upper surface of the concrete concavo-convex type shear key of the precast concrete shear-key block, and thus the concavo-convex type shear key can be very precisely constructed according to a predetermined standard, and it is also possible to solve the problem of the rubber-based anti-vibration pad having lowered anti-vibration performance and durability.

Advantageous Effects

In the vibration isolation structure divided into the upper structure and the lower structure by the internal anti-vibration pad, when the anti-vibration pad integrated with the reaction filler of the present invention is used, the durability and the safety of the anti-vibration pad can be sufficiently ensured, even when a high compressive force is applied.

Further, according to the present invention, since the concavo-convex type shear key is formed at the vibration isolation structure using the precast concrete shear-key block, the concavo-convex type shear key can be very precisely constructed according to the predetermined standard, and thus constructability thereof is very excellent.

Therefore, even when a residential structure is constructed directly on an upper portion of a section, such as a railroad site, in which the vibration is always generated, it is possible to block and control the vibration or the noise more effectively.

MODES OF THE INVENTION

Figure 1:
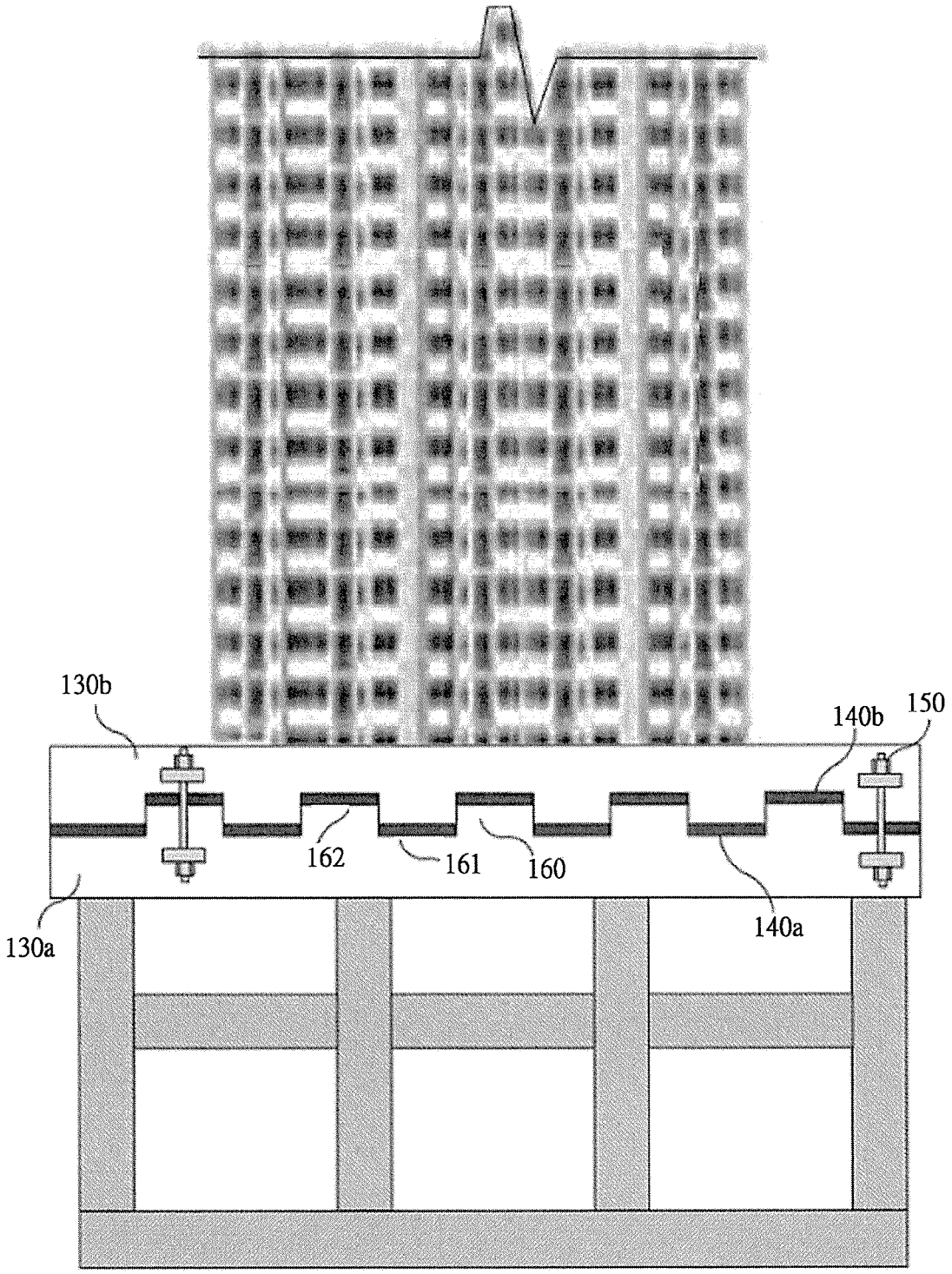
FIG. 1 is a perspective view of a conventional integral type transfer floor structure of apartment housing having a concrete shear key and an anti-vibration pad.

A vibration isolation structure using a precast concrete shear-key block and an anti-vibration pad according to the embodiment of the present invention is as follows. The vibration isolation structure which is divided into a lower structure and an upper structure by an anti-vibration pad for vibration isolation includes the lower structure formed by pouring and curing concrete; a precast concrete shear-key block arranged on the lower structure at a predetermined interval to expose a concavo-convex type shear key; the anti-vibration pad installed at a space between an upper surface of the precast concrete shear-key block and the precast concrete shear-key block; and the upper structure formed at the precast concrete shear-key block by pouring and curing concrete, wherein the precast concrete shear-key block is integrated with the lower structure by a shear stud extending from an inner side thereof.

A method of constructing the vibration isolation structure using a precast concrete shear-key block and an anti-vibration pad according to the embodiment of the present invention is as follows. The method of constructing a vibration isolation structure which is divided into a lower structure and an upper structure by an anti-vibration pad for vibration isolation includes a) assembling a rebar and a form for forming the lower structure divided by the anti-vibration pad; b) manufacturing a precast concrete shear-key block with a shear stud and carrying the manufactured precast concrete shear-key block into a construction site; c) connecting and installing the shear stud of the precast concrete shear-key block on the rebar of the lower structure; d) pouring concrete into a space between the precast concrete shear-key blocks and curing the concrete to form the lower structure; e) installing the anti-vibration pad on an upper surface of the precast concrete shear-key block and a concrete pouring surface of the lower structure; and f) forming the upper structure on the anti-vibration pad, thereby forming the structure.

At this time, the anti-vibration pad has an reaction filler, installed additionally, integrally formed in a clearance formed between the anti-vibration pad and a side surface of the concavo-convex type shear key.

Hereinafter, exemplary embodiments of the present invention will be described in detail with reference to the accompanying drawings to be easily implemented by those skilled in the art. However, the present invention may be embodied in different forms and should not be construed as limited to the embodiments set forth herein. In the drawings, portions irrelevant to the explanation are omitted such that the present invention may be clearly described, and the same components are designated by the same reference numerals throughout the specification.

In the specification, when it is described that a certain portion includes a certain component, this does not indicate that other components are excluded, but the portion may further include other components unless specifically described otherwise.

[Anti-Vibration Pad 140 Integrated with Reaction Filler 141]

The anti-vibration pad integrated with a reaction filler 141 according to the present invention is a rubber-based anti-vibration pad 142.

For example, expanded polystyrene (EPS) and expanded polypropylene (EPP) are used as foam resin materials to absorb vibration or shock.

However, when a high compressive force is applied to the rubber-based anti-vibration pad 142, anti-vibration performance thereof is deteriorated due to the compaction phenomena of the material, and durability thereof is also lowered.

In particular, since the rubber-based anti-vibration pad 142 has an incompressible property (in which a volume before and after deformation does not change), horizontal deformation is generated in proportion to a compressive strain rate which is vertically generated by a compressive force.

Figure 2A:
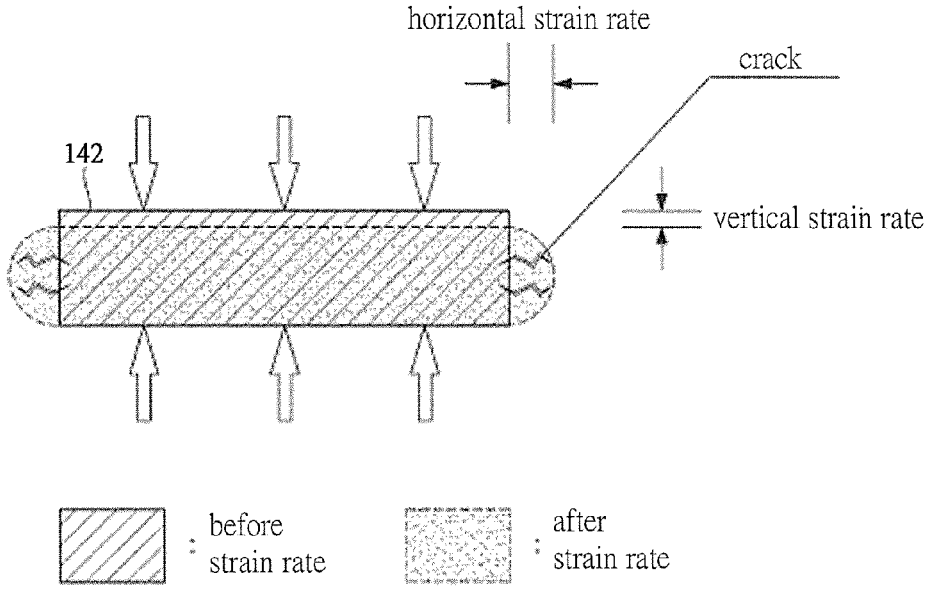
FIGS. 2*a*, 2*b* and 2*c* are views illustrating response states of an anti-vibration pad to an applied compressive load according to the present invention.

Therefore, as illustrated in FIG. 2*a*, when the high compressive force is generated at the rubber-based anti-vibration pad 142 (for example, when the number of floors of a building on a transfer floor or a foundation structure is increased), a horizontal strain rate is considerably increased. If the horizontal strain rate exceeds a predetermined value, a crack is generated at a side surface of the rubber-based anti-vibration pad 142, and an effective cross section is reduced.

Therefore, a repeated phenomenon of increase in the compressive deformation in the vertical direction→increase in deformation in the horizontal direction→occurrence of a crack→reduction in the effective cross section→additionally increase in the compressive deformation in the vertical direction due to the high compressive force applied to the rubber-based anti-vibration pad 142 restricts the application of the rubber-based anti-vibration pad 142.

Figure 2B:
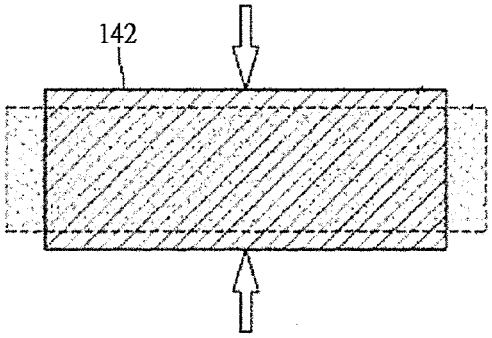
Figure 2B:
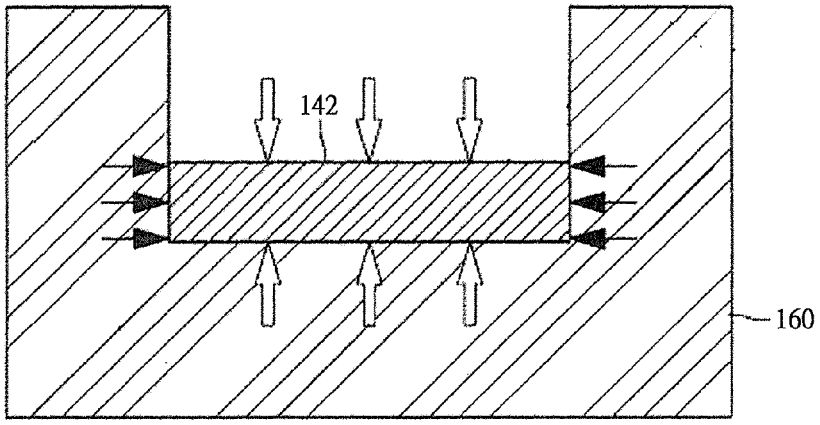

FIG. 2*b* illustrates a specific case in which the rubber-based anti-vibration pad 142 is installed at a concavo-convex type shear key 160.

That is, when the rubber-based anti-vibration pad 142 is installed at the concavo-convex type shear key 160 formed at the vibration isolation structure which is divided into a lower structure and an upper structure by the anti-vibration pad, the compressive deformation is generated due to the incompressible property, and the horizontal deformation is also generated. Therefore, the side surface of the rubber-based anti-vibration pad 142 is restricted by the concavo-convex type shear key 160, and the horizontal deformation is not generated, and thus the rubber-based anti-vibration pad 142 does not function as an anti-vibration member.

Figure 2C:
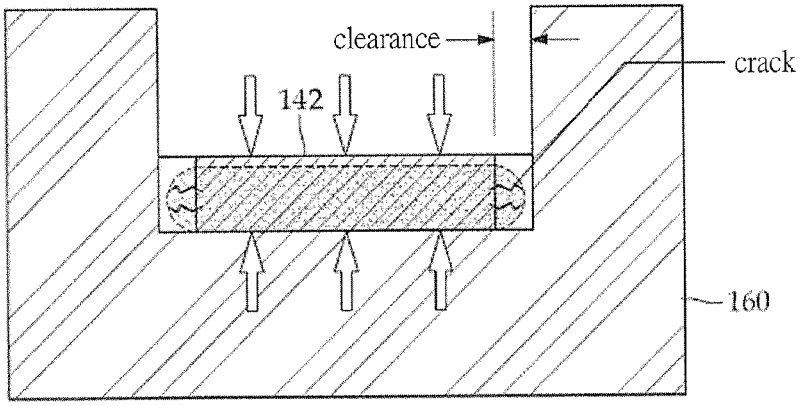

As illustrated in FIG. 2*c*, when only a clearance is formed between the rubber-based anti-vibration pad 142 and the concavo-convex type shear key 160 to allow the horizontal deformation, the horizontal deformation of the rubber-based anti-vibration pad 142 is allowed. However, when the deformation due to the high compressive force is increased, the crack is generated at the side surface thereof, and a vicious circle phenomenon of performance degradation, i.e., the phenomenon of the increase in the compressive deformation in the vertical direction→increase in deformation in the horizontal direction→occurrence of a crack→reduction in the effective cross section→additionally increase in the compressive deformation in the vertical direction, is generated.

Figure 2D:
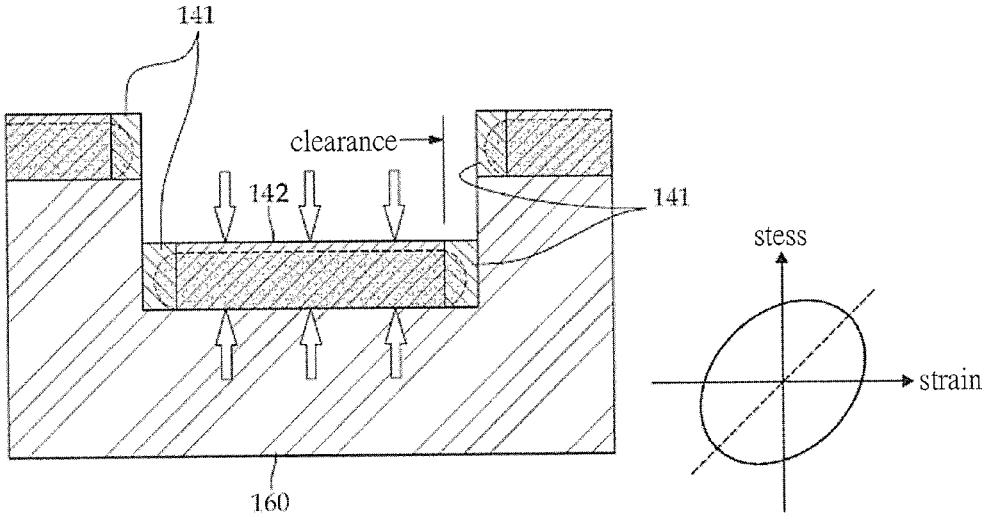
FIG. 2*d* is a view illustrating a response state of an anti-vibration pad using a reaction filler to an applied compressive load according to the present invention.

Therefore, in the present invention, as illustrated in FIG. 2*d*, the clearance is formed between the rubber-based anti-vibration pad 142 and the concavo-convex type shear key 160 to allow the horizontal deformation of the rubber-based anti-vibration pad 142, and a reaction filler 141 having a predetermined stiffness is installed at the clearance.

The reaction filler 141 having the predetermined stiffness is formed of a silicone material or the like to restrict the horizontal strain rate, such that the horizontal deformation of the rubber-based anti-vibration pad 142 is within a predetermined range, as well as to provide a reaction force against the horizontal strain rate, such that the horizontal deformation is returned to its original position.

Further, the reaction filler 141 may provide an attenuation property, as illustrated in a right graph (a stress-strain graph) of FIG. 2*d*, in addition to the predetermined stiffness, and may considerably reduce the stain rate due to vibration, and thus a large effect on vibration control may be expected.

Figure 2E:
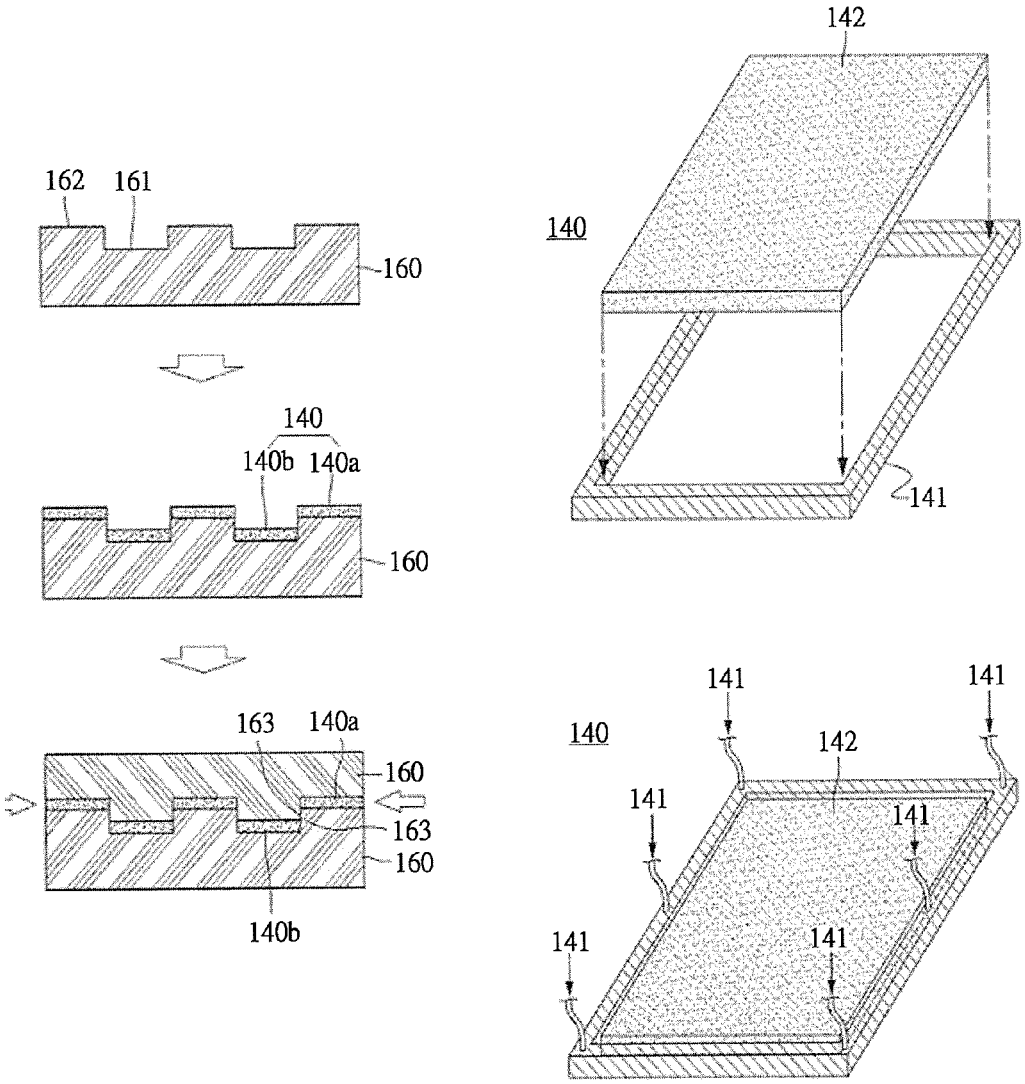
FIG. 2*e* is a view illustrating manufacturing and installation of the anti-vibration pad using the reaction filler according to the present invention.

FIG. 2*e* illustrates an example of manufacturing and installation of the anti-vibration pad 140 having the reaction filler 141 of the present invention.

That is, the anti-vibration pad 140 integrated with the reactor filler is installed at the concavo-convex type shear key 160 of which an upper surface 161 and a lower surface 162 are engaged with each other and side surfaces 163 are directly in contact with each other so that the deformation is not generated.

Specifically, an upper anti-vibration pad 140*a* integrated with the reaction filler 141 is installed on the upper surface 161 of the concavo-convex type shear key 160, and a lower anti-vibration pad 140*b* integrated with the reaction filler 141 is installed on the lower surface 162 of the concavo-convex type shear key 160.

At this time, as illustrated in FIG. 2*d*, the reaction filler 141 is formed in the clearance, which is formed between the anti-vibration pad 140 and the concavo-convex type shear key 160, to allow the horizontal deformation of the upper and lower anti-vibration pads 140*a* and 140*b*. When the concavo-convex type shear key 160 is basically formed in a rectangular shape, and thus the anti-vibration pad and the filler therearound are also basically formed in the rectangular shape, the anti-vibration pad and the reaction filler may be formed and constructed in a frame shape, as illustrated in FIG. 2*e*.

At this time, the frame-shaped reaction filler 141 may be previously integrally formed around the upper and lower anti-vibration pads 140*a* and 140*b*, or the upper and lower anti-vibration pads 140*a* and 140*b* may be first installed on the upper surface (or portion) 161 of the concavo-convex type shear key 160 and the lower surface (or portion) 162 of the concavo-convex type shear key 160, respectively, and then the reaction filler 141 may be formed in the clearance between the upper and lower anti-vibration pads 140*a* and 140*b* and the side surface 163 of the concavo-convex type shear key.

Here, the anti-vibration pad 140 is integrated with the reaction filler 141, and the reaction filler 141 is not separately indicated in the drawings. However, the reaction filler 141 is assumed to be integrally formed with the anti-vibration pad 140. Hereinafter, the anti-vibration pad integrated with the reaction filler 141 is simply called the "anti-vibration pad."

[Vibration Isolation Structure Using Precast Concrete Shear-Key Block and Anti-Vibration Pad]

Figure 3A:
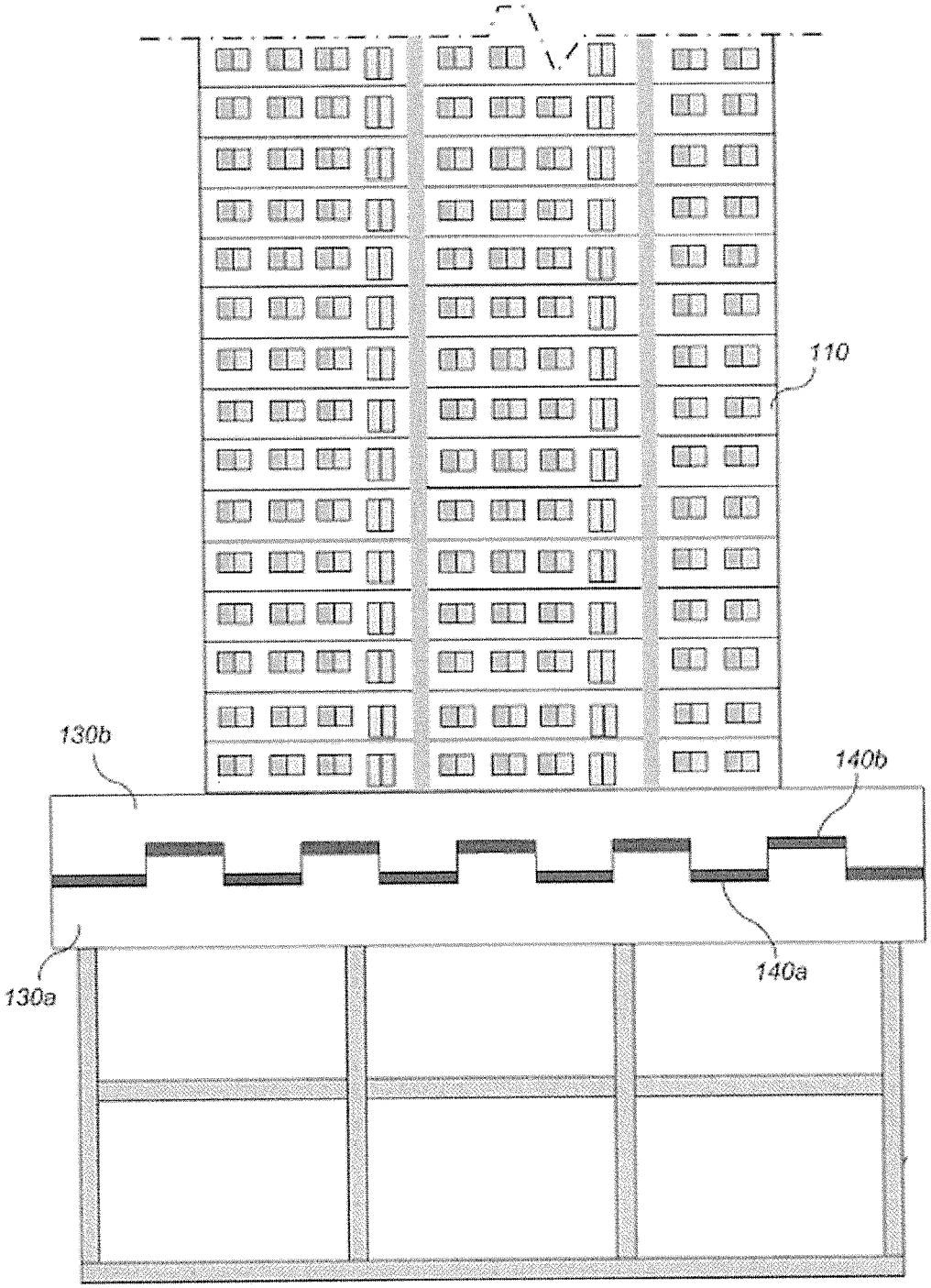
FIGS. 3*a* and 3*b* are views illustrating an example of a vibration isolation structure having a concavo-convex type shear key according to an embodiment of the present invention.
Figure 3B:
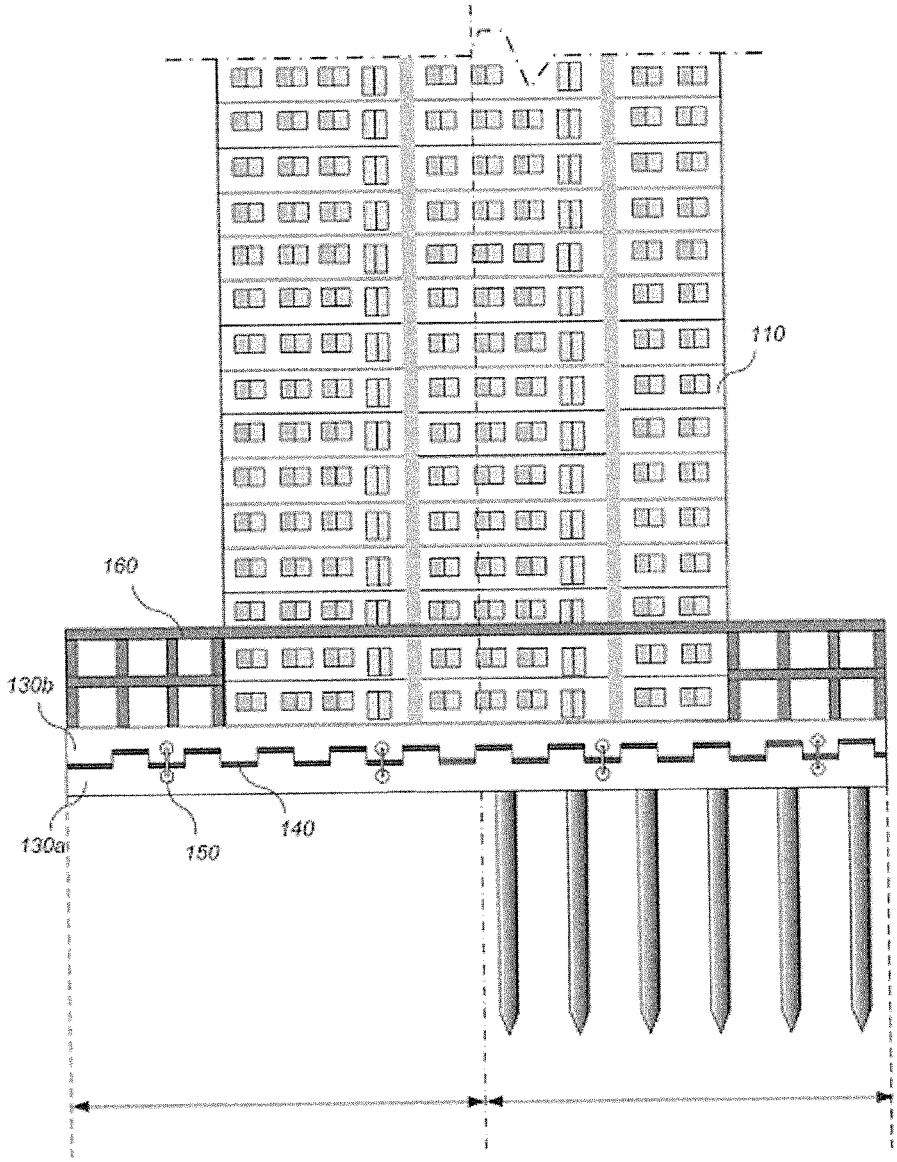

Meanwhile, FIGS. 3*a* and 3*b* are views exemplarily illustrating cross-sectional shapes of a vibration isolation transfer floor structure having the concavo-convex type shear key and a vibration isolation foundation structure, respectively. Here, FIG. 3*a* is a cross-sectional shape of the vibration isolation transfer floor structure having the concavo-convex type shear key, and FIG. 3*b* is a cross-sectional shape of the vibration isolation foundation structure having the concavo-convex type shear key.

Referring to FIGS. 3*a* and 3*b*, the vibration isolation structure, for example, the transfer floor structure or the foundation structure, is basically formed so that a lower structure 130*a* and an upper structure 130*b* of the transfer floor structure or the foundation structure are engaged by a plurality of concavo-convex type shear keys 160 with an installation portion of the anti-vibration pad 140 as the center so as to withstand a lateral force.

Therefore, the anti-vibration pad 140 integrated with the reaction filler 141 is installed between the upper and lower structures 130*a* and 130*b*, and the upper and lower structures 130*a* and 130*b* are formed to have the concavo-convex type shear key 160. Further, the anti-vibration pad 140 between the upper and lower structures 130*a* and 130*b* is installed to be restricted by the tension restriction member 150, and thus the vibration isolation structure may be provided.

As illustrated in FIGS. 3*a* and 3*b*, an end of the tension restriction member 150 is anchored between the upper and lower structures 130*a* and 130*b*, and the tension restriction member 150 is constructed in an unbonded state to absorb the vertical displacement and thus the vibration during the construction.

Specifically the tension restriction member 150 is formed to be re-fixed so that a vertical shortening amount of the upper and lower anti-vibration pads 140*a* and 140*b* integrated with the reaction filler for each stage according to an increase in a vertical load is absorbed at one of upper and lower anchorages thereof. For example, the tension restriction member 150 may be a bolt-fastening type tension restriction member.

Further, the tension restriction member 150 may be provided with a shock transmission unit (STU) so that displacement is not restricted when micro-vibration occurs, but larger displacement according to impact vibration in the event of an earthquake is strongly restricted, thereby always blocking noise or vibration due to the micro-vibration.

[Precast Concrete Shear-Key Block 200 and Anti-Vibration Pad 140]

The above-described anti-vibration pad 140 is installed at the concavo-convex type shear key 160. In the case of the upper and lower structures 130*a* and 130*b* divided by the anti-vibration pad 140 therein, there is a problem in that it is not easy to precisely construct the concavo-convex type shear key 160 and the anti-vibration pad 140 according to a predetermined standard.

Therefore, in the vibration isolation structure using the precast concrete shear-key block and the anti-vibration pad according to the embodiment of the present invention, the precast concrete shear-key block and the anti-vibration pad are manufactured (in a precast manner) at separate plants to be assembled on a construction site.

Here, the precast concrete shear-key block 200 is a unit plate or a unit block, and the various shear keys having various shapes and sizes are formed in the precast manner.

Figure 4:
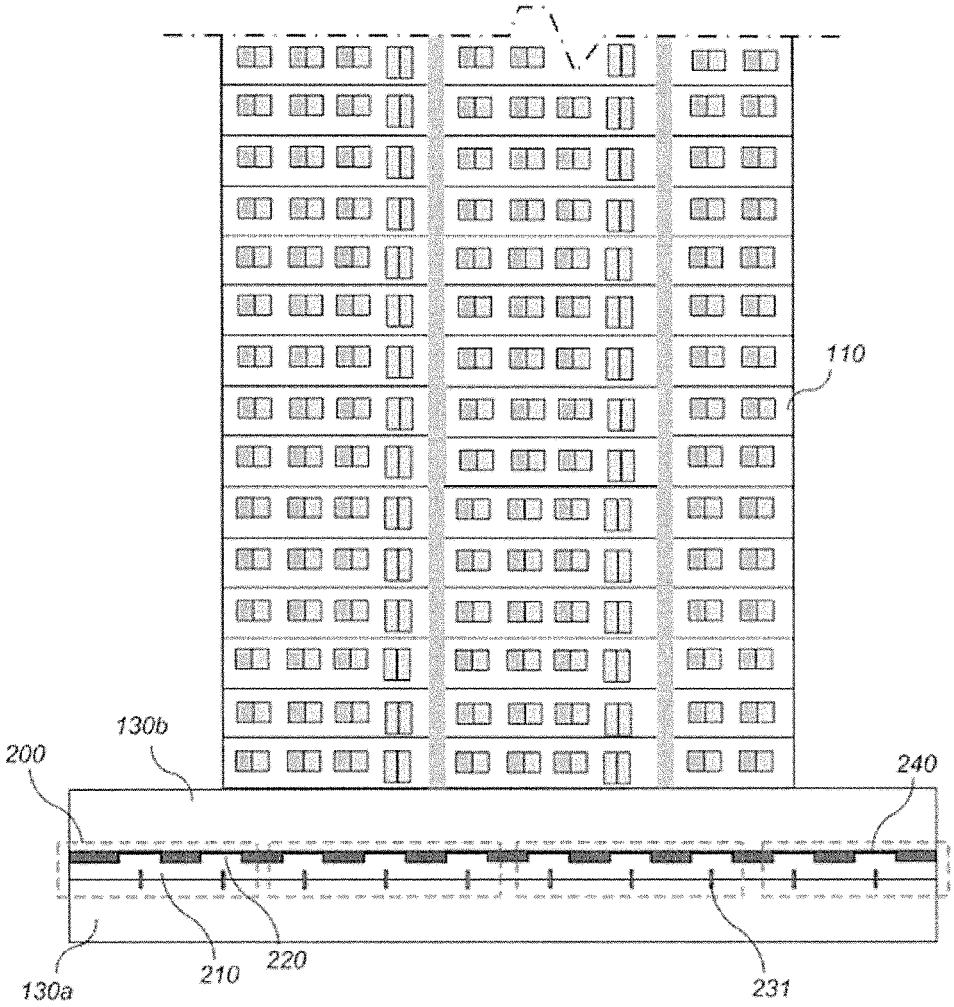
FIG. 4 is a view illustrating an example of a vibration isolation structure having a precast concrete shear-key block and an anti-vibration pad according to the embodiment of the present invention.

FIG. 4 is a view schematically illustrating an example of the vibration isolation structure using the precast concrete shear-key block 200 and the anti-vibration pad according to the embodiment of the present invention.

Referring to FIG. 4, the vibration isolation structure using the precast concrete shear-key block and the anti-vibration pad according to the embodiment of the present invention is a structure which is divided into the lower structure and the upper structure by the anti-vibration pad, and may include the lower structure 130*a*, the upper structure 130*b*, the precast concrete shear-key block 200 and the anti-vibration pad 240.

The lower structure 130*a* is, for example, the transfer floor structure or the foundation structure, and is formed by pouring and curing concrete.

The upper structure 130*b* is, for example, the transfer floor structure or the residential and commercial complex building 110 which is formed to be separated from the lower structure 130*a* by the anti-vibration pad 240, and is formed on the anti-vibration pad 240 by pouring and curing concrete.

The precast concrete shear-key block 200 is arranged a predetermined distance from the lower structure 130*a* to restrict horizontal movement of the lower and upper structures 130*a* and 130*b* due to the earthquake or wind load, and a shear stud 231 is formed to extend from an inner side thereof.

At this time, the shear stud 231 of the precast concrete shear-key block 200 may be connected and integrated with an inner rebar of the lower structure 130*a*.

Here, to manufacture the precast concrete shear-key block 200, a steel form 190 which is formed to protrude downward at a predetermined interval and to have a predetermined area is used. The area, the interval and a row of a concavo-convex portion of the steel form 190 may be adjusted as necessary.

Further, the precast concrete shear-key block 200 may be temporarily disposed at the inner rebar arranged at the lower structure 130*a* by spot welding, and may have a fine adjustment knob (not shown) which adjusts the precast concrete shear-key block 200 to keep it level. Further, the precast concrete shear-key block 200 may have an air hole which checks whether concrete forming the lower structure 130*a* is poured.

The anti-vibration pad 240 is installed at a space between an upper surface of the precast concrete shear-key block 200 and the precast concrete shear-key block 200 to absorb internal vibration of the lower and upper structures 130*a* and 130*b*.

At this time, a size and a shape of the anti-vibration pad 240 may be selectively manufactured and installed according to the precast concrete shear-key block 200, and the anti-vibration pad 240 is installed so that an entire upper surface thereof remains level.

Figure 5:
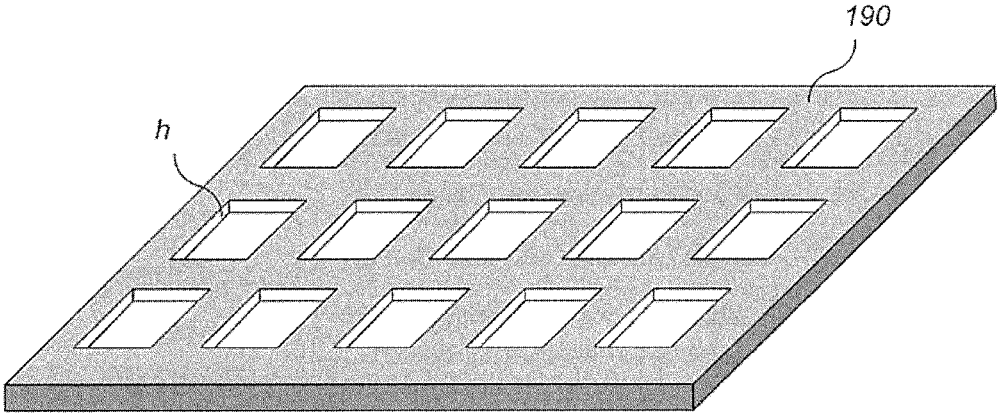
FIG. 5 is a view illustrating a steel form for manufacturing the precast concrete shear-key block according to the embodiment of the present invention.

Meanwhile, FIG. 5 is a view illustrating the steel form 190 for manufacturing the precast concrete shear-key block according to the embodiment of the present invention, wherein the steel form forms the precast concrete shear-key block in an intagliated concavo-convex portion h.

In the vibration isolation structure using the precast concrete shear-key block and the anti-vibration pad according to the embodiment of the present invention, the area, the interval and the row of the concavo-convex portion h of the steel form 190 for manufacturing the precast concrete shear-key block may be adjusted as necessary.

Figure 6:
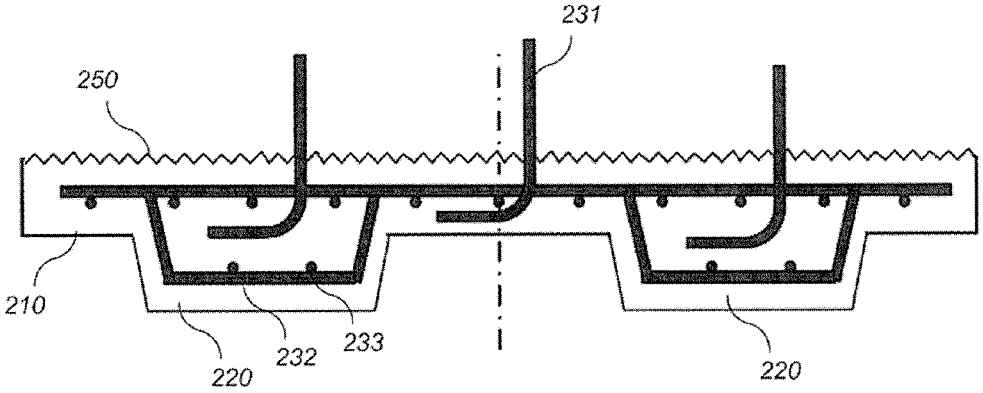
FIGS. 6 and 7 are a cross-sectional view and a perspective view of the precast concrete shear-key block according to the embodiment of the present invention.
Figure 7:
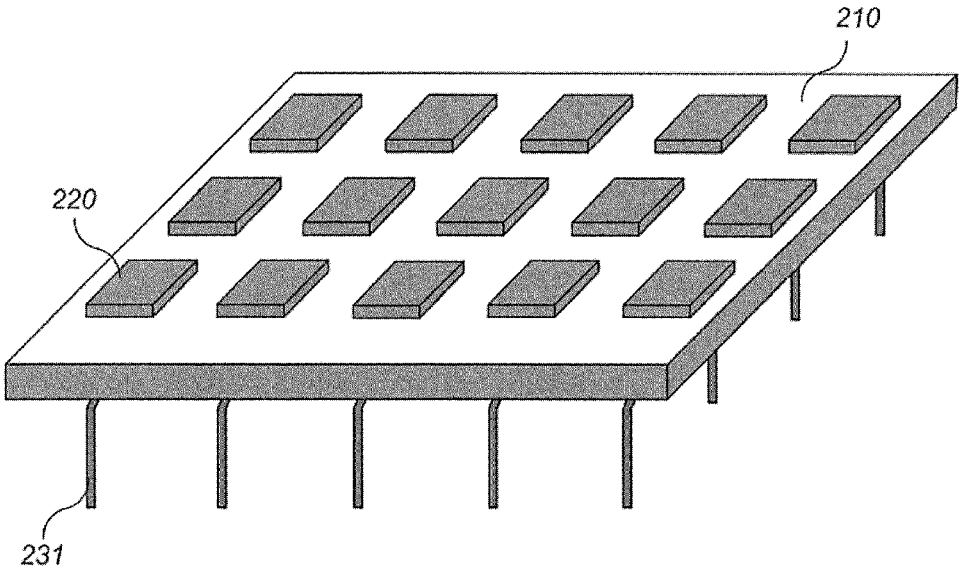

Meanwhile, FIG. 6 is a cross-sectional view of the precast concrete shear-key block according to the embodiment of the present invention, and FIG. 7 is a perspective view of the precast concrete shear-key block according to the embodiment of the present invention.

Referring to FIGS. 6 and 7, the precast concrete shear-key block 200 according to the embodiment of the present invention may include a concrete body 210, a concrete concavo-convex type shear key 220, a shear stud 231, and a transverse rebar 232 and a longitudinal rebar 233 which are the internal rebars.

The concrete concavo-convex type shear key 220 is formed in a concavo-convex portion to protrude from the concrete body 210.

To reinforce the precast concrete shear-key block 200 including the concrete concavo-convex type shear key 220 manufactured to have a predetermined thickness, a wire mesh or the internal rebar is provided.

For example, the transverse rebar 232 is transversely arranged in the concrete body 210, and the longitudinal rebar 233 is longitudinally arranged in the concrete body 210 to be connected with the transverse rebar 232.

At this time, in the precast concrete shear-key block 200, a rebar for inherent reinforcement and another rebar serving as the shear stud 231 which will be later connected with the lower structure 130*a* to transmit the shear force to a lower portion of the concrete concavo-convex type shear key 220 are arranged.

That is, the shear stud 231 for transmitting a shear force is vertically connected with the internal rebar disposed to form the lower structure 130*a*.

At this time, in the precast concrete shear-key block 200, it is preferable that a concrete surface 250 of a lower portion of the concrete concavo-convex type shear key 220 be roughly finished so as to increase an adhesive force with concrete of the lower structure 130*a* to be poured later.

For example, after an assembling operation of the transverse rebar 232, the longitudinal rebar 233 and the shear stud 231 is completed, the precast concrete shear-key block 200 is completed by pouring concrete. At this time, the concrete surface 250 is finished as roughly as possible so as to increase the adhesive force with the concrete to be poured later.

Figure 8:
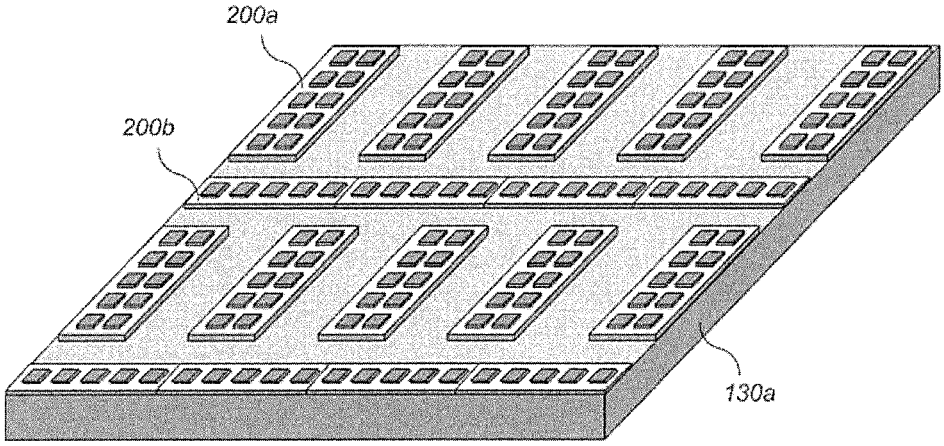
FIG. 8 is a view illustrating an installation example of the precast concrete shear-key block according to the embodiment of the present invention.

Meanwhile, FIG. 8 is a view illustrating an example in which the precast concrete shear-key block is variously installed on the lower structure of the vibration isolation structure using the precast concrete shear-key block and the anti-vibration pad according to the embodiment of the present invention, wherein the precast concrete shear-key block 200 is variously installed on the lower structure 130*a*.

The precast concrete shear-key block 200 according to the embodiment of the present invention is manufactured and molded through the curing of the concrete for a predetermined period of time, and then carried into a construction site. As illustrated in FIG. 8, the precast concrete shear-key block 200 may be installed on the lower structure 130*a*. For example, a longitudinal precast concrete shear-key block 200*a* and a transverse precast concrete shear-key block 200*b* may be installed on the lower structure 130*a*.

At this time, it is preferable that the manufactured precast concrete shear-key block 200 be overturned and disposed on the rebar arranged in the lower structure 130*a*, for example, temporarily disposed on the rebar arranged in the lower structure 130*a* by spot welding, and then adjusted to remain level using the fine adjustment knob (not shown) or the like.

Further, the precast concrete shear-key block 200 may be provided in the form of a unit plate, and the concrete is poured in an empty space in which the plurality of precast concrete shear-key blocks 200 are installed, and thus the lower structure 130*a* is formed.

At this time, to pour the concrete smoothly, an air hole or the like checking whether the concrete is poured may be formed in the precast concrete shear-key block 200.

Figure 9A:
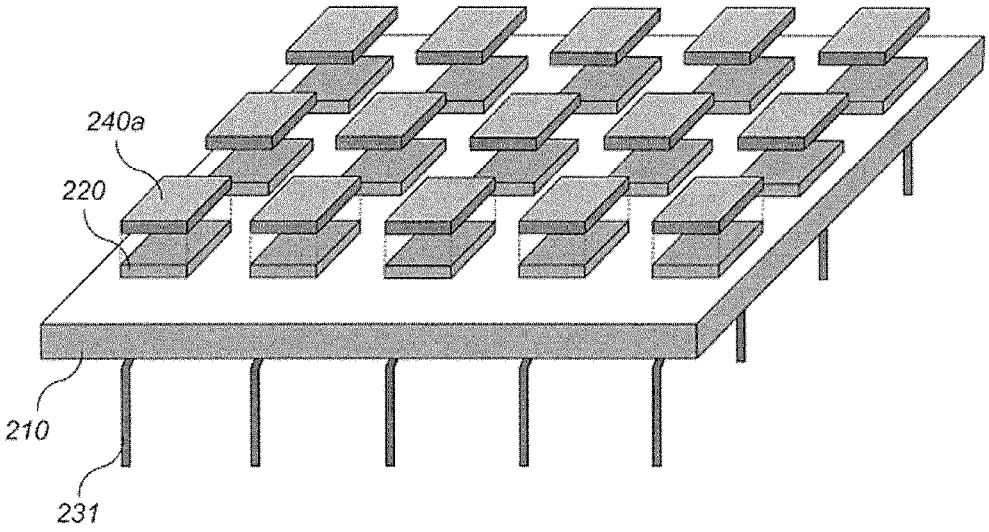
FIGS. 9*a* and 9*b* are views illustrating installation examples of the anti-vibration pad according to the embodiment of the present invention.
Figure 9B:
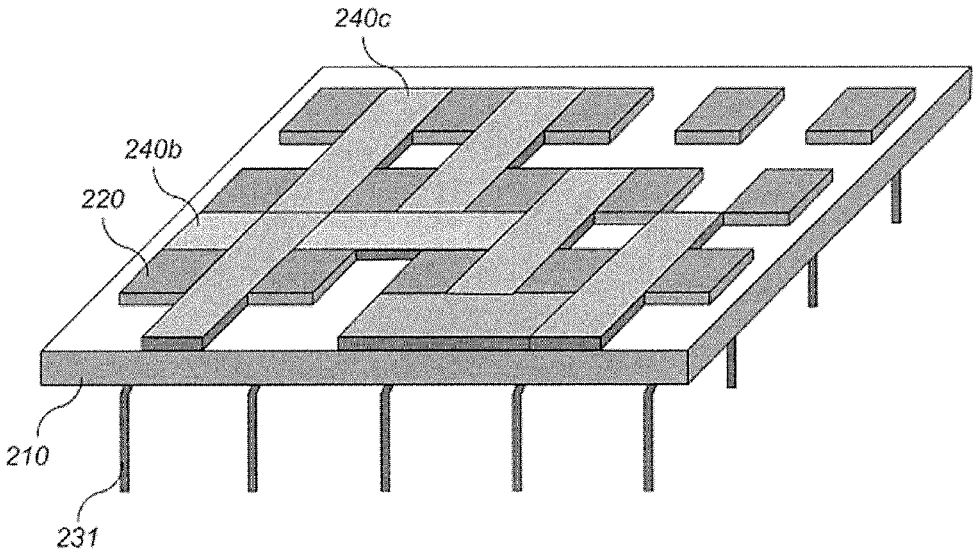
Figure 10:
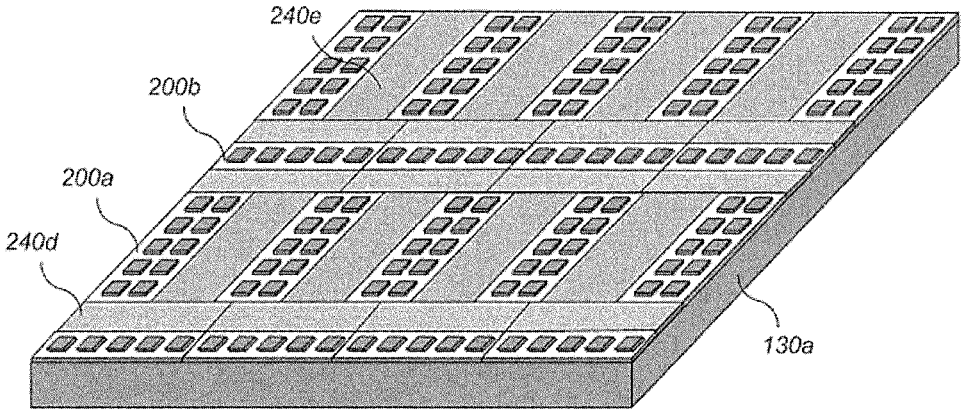
FIG. 10 is a view illustrating an installation example of the anti-vibration pad installed on the precast concrete shear-key block exposed on a concrete pouring surface of the lower structure in the vibration isolation structure according to the embodiment of the present invention.

Meanwhile, FIGS. 9*a* and 9*b* are views illustrating examples in which the anti-vibration pad is installed on upper and lower surfaces of the concavo-convex type shear key of the precast concrete shear-key block in the vibration isolation structure using the precast concrete shear-key block and the anti-vibration pad according to the embodiment of the present invention, and FIG. 10 is a view illustrating an example of the anti-vibration pad installed on the concrete pouring surface of the lower structure in the vibration isolation structure using the precast concrete shear-key block and the anti-vibration pad according to the embodiment of the present invention.

In the vibration isolation structure using the precast concrete shear-key block and the anti-vibration pad according to the embodiment of the present invention, after the pouring of the concrete with respect to the lower structure 130*a* is completed, the anti-vibration pad 240 is installed on the molded precast concrete shear-key block 200. At this time, a size and a shape of the anti-vibration pad 240 are selectively manufactured and installed according the precast concrete shear-key block 200, and the anti-vibration pad 240 is preferably installed so that the entire upper surface thereof maintains level.

For example, FIG. 9*a* illustrates a state in which an anti-vibration pad 240*a* is installed on the concrete concavo-convex type shear key 220 of the precast concrete shear-key block 200, and FIG. 9*b* illustrates a state in which a transverse anti-vibration pad 240*a* and a longitudinal anti-vibration pad 240*b* are installed on the concrete concavo-convex type shear keys 220 of the precast concrete shear-key block 200.

Further, FIG. 10 illustrates a state in which a longitudinal precast concrete shear-key block 200*a* and a transverse precast concrete shear-key block 200*b* are installed on the lower structure 130*a*, and a transverse anti-vibration pad 240*a* and a longitudinal anti-vibration pad 240*b* are installed on the concrete pouring surface of the lower structure 130*a*.

[Method of Constructing Vibration Isolation Structure Using the Precast Concrete Shear-Key Block and the Anti-Vibration Pad]

Figure 11:
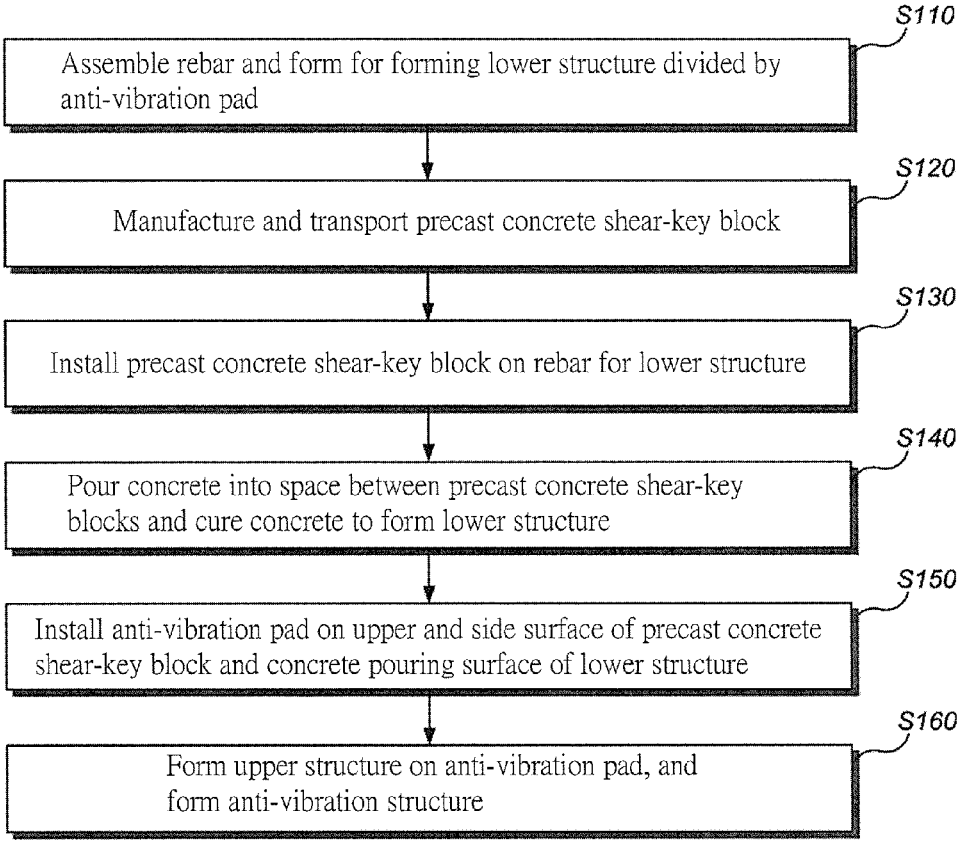
FIG. 11 is a flowchart illustrating a method of constructing the vibration isolation structure using the precast concrete shear-key block and the anti-vibration pad according to the embodiment of the present invention.

FIG. 11 is a flowchart illustrating a method of constructing the vibration isolation structure using the precast concrete shear-key block and the anti-vibration pad according to the embodiment of the present invention.

Referring to FIG. 11, the method of constructing the vibration isolation structure using the precast concrete shear-key block and the anti-vibration pad according to the embodiment of the present invention is a method for controlling anti-vibration of the structure divided into the lower structure and the upper structure to block vibration. First, the rebar and the form for forming the lower structure 130*a* divided by the anti-vibration pad 240 are assembled (S110).

Then, the precast concrete shear-key block 200 having the shear stud 231 is manufactured and then carried into the construction site (S120). At this time, to manufacture the precast concrete shear-key block 200, the steel form 190 formed to protrude downward at a predetermined interval and to have a predetermined area is used. The area, the interval and the row of the concavo-convex portion of the steel form 190 may be adjusted as necessary. For example, the precast concrete shear-key block 200 includes the concrete body 210, the concrete concavo-convex type shear key 220, the shear stud 231, the transverse rebar 232, and the longitudinal rebar 233. Preferably, in the precast concrete shear-key block 200, the concrete surface 250 of the lower portion of the concrete concavo-convex type shear key 220 is roughly finished so as to increase the adhesive force with the concrete for the lower structure 130*a* to be poured later.

Then, the precast concrete shear-key block 200 is installed on the rebar of the lower structure (S130).

Then, the concrete is poured into and cured in a space between the precast concrete shear-key blocks 200 to form the lower structure 130*a* (S140). Therefore, the shear stud 231 of the precast concrete shear-key block 200 is connected and integrated with the rebar of the lower structure 130*a*.

Then, the anti-vibration pad 240 is installed on upper and lower surfaces of the precast concrete shear-key block 200 and the concrete pouring surface of the lower structure 130*a*, respectively (S150).

At this time, the size and the shape of the anti-vibration pad 240 are selectively manufactured and installed according to the precast concrete shear-key block 200. The anti-vibration pad 240 is installed so that the entire surface thereof remains level.

Then, the upper structure is formed on the anti-vibration pad 240, and thus the anti-vibration structure is foamed (S160).

According to the embodiment of the present invention, in a structure which forms an upper structure and a lower structure divided by an anti-vibration pad therein, since the concavo-convex type shear key is formed using the precast concrete shear-key block, the construction can be precisely performed according to the predetermined standard. Further, since the concrete concavo-convex type shear key and the anti-vibration pad are manufactured at separate plants in the precast manner so as to be assembled on the construction site, the constructability thereof can be enhanced, and thus the vibration or the noise can be more effectively blocked.

It will be understood that the foregoing description of the present invention is for illustrative purposes only, and that one of ordinary skill in the art can make various substitutions, alternations and changes without any change in the technical spirit or the essential characteristics of the present invention. Therefore, the above-described embodiments are illustrative, and do not limit the scope of the claims. For example, a single element may be implemented in the form of dispersed elements, and dispersed elements may be implemented in the formed of a combined single element.

Although a few embodiments of the present invention have been shown and described, it would be appreciated by those skilled in the art that changes may be made in these embodiments without departing from the principles and spirit of the invention, the scope of which is defined in the claims and their equivalents.

INDUSTRIAL APPLICABILITY

When a road, or a subway or other railroad is constructed around a structure, vibration may be transmitted to the structure. Since the vibration deteriorates usability of the structure, a means for blocking the vibration is required, and particularly, in the case of a structure with pilot is constructed above the railroad, the anti-vibration technique is very important.

Therefore, by the vibration isolation structure using the precast concrete shear-key block and the anti-vibration pad, and the constructing method thereof according to the present invention, in a structure such as a complex structure, a shopping center and a residential structure (an apartment or the like), and particularly, in a foundation plate or a transfer floor of the structure, it is possible to control the vibration and also to prevent an influence of the vibration or the noise transmitted from therearound using the anti-vibration pad having excellent durability and safety.

The invention claimed is:

1. A vibration isolation structure using a precast concrete shear-key block and anti-vibration pads, wherein the vibration isolation structure is divided into a lower structure and an upper structure by the anti-vibration pads for vibration isolation, comprising:

the lower structure configured to serve as a transfer floor structure or a foundation structure and formed by pouring and curing concrete;

the upper structure formed on the anti-vibration pads by pouring and curing concrete;

the precast concrete shear-key block arranged on the lower structure at a predetermined interval to restrict horizontal movement of the upper and lower structure, and the precast concrete shear-key block having shear studs formed to be perpendicular to a plurality of shear keys that protrude from the shear-key block, wherein the precast concrete shear-key block comprises:

a concrete body;

the plurality of shear keys arranged to have a space from each other;

the shear stud, correspondingly located below each of the shear keys and perpendicularly connected with a rebar arranged to form the lower structure and to transmit a shear force; and a transverse rebar and a longitudinal rebar transversely and longitudinally arranged in the concrete body;

the anti-vibration pads are installed between upper and lower surfaces of the precast concrete shear-key block and between the shear keys, the anti-vibration pads having incompressible characteristics to absorb vibration in the upper and lower structure, wherein the shear studs of the precast concrete shear-key block are connected and integrated with the lower structure.

2. The vibration isolation structure of claim 1, wherein, in the precast concrete shear-key block, a concrete surface of a lower portion of each of the shear keys is finished to increase an adhesive force with concrete of the lower structure to be poured later.

3. The vibration isolation structure of claim 1, wherein a steel form which is formed to protrude downward at a predetermined interval and to have a predetermined area is used to manufacture the precast concrete shear-key block, and, in the steel form, the predetermined area, the predetermined interval and a row of a portion protruding downward are adjusted as necessary.

4. The vibration isolation structure of claim 1, wherein the anti-vibration pad is installed to include an upper anti-vibration pad integrated with a reaction filler installed at an upper surface of the shear key, and a lower anti-vibration pad integrated with the reaction filler installed at a lower surfaces between the shear keys, and the reaction filler is formed at a clearance between the anti-vibration pad and a side surface of each of the shear keys to allow horizontal displacement of the upper and lower anti-vibration pad.

5. The vibration isolation structure of claim 4, wherein the reaction filler is integrally formed around the upper and lower anti-vibration pads.

6. The vibration isolation structure of claim 4, further comprising a tension restriction member installed at the lower and upper structures to absorb vertical displacement and to restrict a vertical load, wherein the tension restriction member with ends of the tension restriction member anchored between the upper and lower structures is formed to be refixed so that a vertical shortening amount of the upper and lower anti-vibration pads integrated with the reaction filler for each stage according to an increase in a vertical load is absorbed at one of upper and lower anchorages thereof.

7. The vibration isolation structure of claim 4, wherein the upper and lower anti-vibration pads are first installed on the upper surface of the shear keys and the lower surface between each of the shear keys, respectively, and then the reaction filler is formed in the clearance between the upper and lower anti-vibration pads and the side surface of each of the shear keys.

* * * * *